US005909855A

United States Patent [19]

Jorkama et al.

[11] Patent Number: 5,909,855

[45] Date of Patent: Jun. 8, 1999

[54] METHOD FOR WINDING A PAPER WEB

[75] Inventors: Marko Jorkama, Järvenpää ; Jarmo Mäkelä , Kerava, both of Finland

[73] Assignee: Valmet Corporation, Helsinki, Finland

[21] Appl. No.: 08/960,147

[22] Filed: Oct. 29, 1997

[30] Foreign Application Priority Data

Oct. 29, 1996 [FI] Finland ..... 964355

[51] Int. Cl.[6] ..... B65H 23/198

[52] U.S. Cl. ..... 242/414.1

[58] Field of Search ..... 242/412, 414, 242/414.1, 413, 413.9, 415, 415.1; 318/6

[56] References Cited

U.S. PATENT DOCUMENTS

| | | | |
|---|---|---|---|
| 3,764,087 | 10/1973 | Paananen et al. | 242/414.1 |
| 3,913,866 | 10/1975 | Hankins | 242/414.1 |
| 4,307,848 | 12/1981 | Barathieu | 242/414.1 |

FOREIGN PATENT DOCUMENTS

| | | |
|---|---|---|
| 62-240252 | 10/1987 | Japan . |
| 63-267650 | 11/1988 | Japan . |
| 6-80289 | 3/1994 | Japan . |

*Primary Examiner*—John M. Jillions
*Attorney, Agent, or Firm*—Steinberg & Raskin, P.C.

[57] ABSTRACT

A method for winding a paper web in which the paper web is wound by a winder or equivalent winding apparatus onto a roll and the running speed of the winder is controlled based on the frequency of rotation of the roll so that when the frequency of rotation of the roll approaches a range of oscillation, i.e., a range of frequency of rotation of the roll in which intensive oscillation occurs, the running speed is lowered quickly so that the frequency of rotation of the roll is reduced to a level lower than the lower frequency of the range of oscillation. Thereafter, the running speed of the winder is increased so that the frequency of rotation of the roll remains substantially constant until, e.g., the running speed of the winder prior to the reduction thereof as the frequency of rotation of the roll approached the range of oscillation is reached.

10 Claims, 2 Drawing Sheets

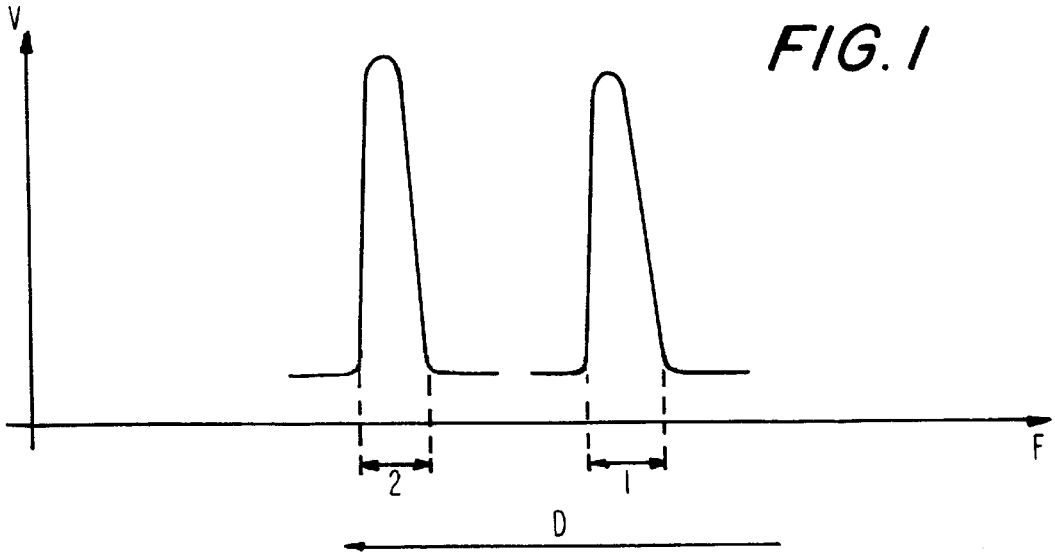
FIG. 1
FIG. 2
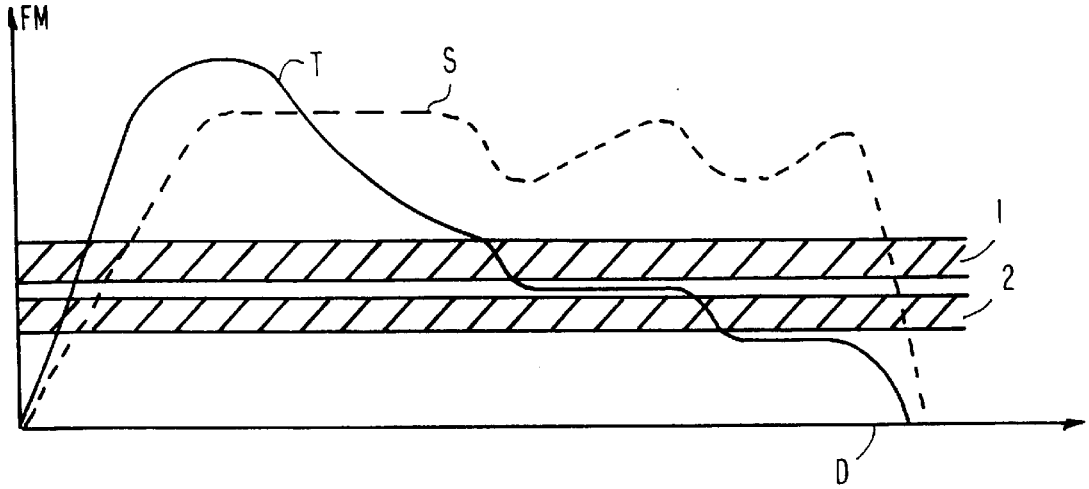

METHOD FOR WINDING A PAPER WEB

FIELD OF THE INVENTION

The present invention relates to a method for winding a paper web in which the paper web is wound by a winder such as a slitter-winder or an equivalent winding device onto a roll and the running speed of the winder is controlled, i.e., the speed at which the web is wound onto the roll.

BACKGROUND OF THE INVENTION

It is known in the prior art that when winding a paper web, for example when the paper web is wound in a slitter-winder, with certain paper grades, for example fine paper or liner papers, intensive oscillation peaks always occur at the same ranges of frequency of rotation of the roll irrespective of the running speed of the slitter-winder. The number of these ranges of oscillation, i.e., ranges of frequency of rotation of the roll, in which intensive oscillation occurs in the slitter-winder, is generally from 1 to 3, depending on the ultimate diameter of the roll being wound. This intensive oscillation produces winding broke, mechanical wear of the equipment, even detaching of the roll from the winding device, and often lowers the winding capacity of the winder because the running speed of the winder must be lowered during winding to avoid these detrimental effects.

OBJECTS AND SUMMARY OF THE INVENTION

An object of the present invention is to provide a method for winding a paper web in which the effects of the ranges of oscillation are eliminated or at least minimized.

It is another object of the present invention to provide a new and improved method for winding a fibrous web.

In view of achieving the objects stated above and others, in the method in accordance with the running speed of the winder, i.e., the speed at which the web is being directed to the roll to be wound thereon, is controlled based on the frequency of rotation of the roll so that when the frequency of rotation of the roll approaches a range of oscillation, i.e., a range of frequencies of rotation of the roll in which intensive oscillation occurs, the running speed is lowered quickly so that the speed of rotation of the roll is reduced to a level at which the frequency of rotation of the roll is lower than the lower frequency of the range of oscillation. Thereafter, the running speed of the winder is increased so that the frequency of rotation of the roll remains invariable, i.e., substantially constant in view of the increasing diameter of the roll, until the original running speed of the winder is reached.

In accordance with the invention, the oscillation of the roll is reduced so that the frequency of rotation of the roll is monitored during running, and the speed of running of the winder is lowered so that the frequency of rotation of the roll at the decreasing winder running speed quickly passes through a known range of oscillation. After this maneuver, the slitter-winder is accelerated back to the running speed by keeping the frequency of rotation of the roll constant, which is possible in view of the increasing diameter of the roll which serves to allow the running speed to be increased while the frequency of rotation of the roll is maintained essentially unchanged. This procedure is repeated at each point or range of oscillation, in which connection, with such "evading of oscillation", the running speed of the slitter-winder or other winding apparatus can be increased because of the reduced oscillation, whereby the effects of the ranges of oscillation can be eliminated almost completely and at least minimized.

In the following, the invention will be described in more detail with reference to the figures in the accompanying drawings. However, the invention is not strictly confined to the details of the illustrated embodiments.

BRIEF DESCRIPTION OF THE DRAWINGS

Additional objects of the invention will be apparent from the following description of the preferred embodiment thereof taken in conjunction with the accompanying non-limiting drawings, in which:

FIG. 1 is a schematic illustration of the oscillation in a winder at an arbitrary, substantially constant running speed as a function of the frequency of rotation of the roll;

FIG. 2 is a schematic illustration of the frequency of rotation of a roll onto which a web is being wound by a winder during changes when oscillation of the roll is minimized in accordance with the invention as a function of the diameter of the roll.

DETAILED DESCRIPTION OF THE PREFERRED EMBODIMENTS

Figure 3:
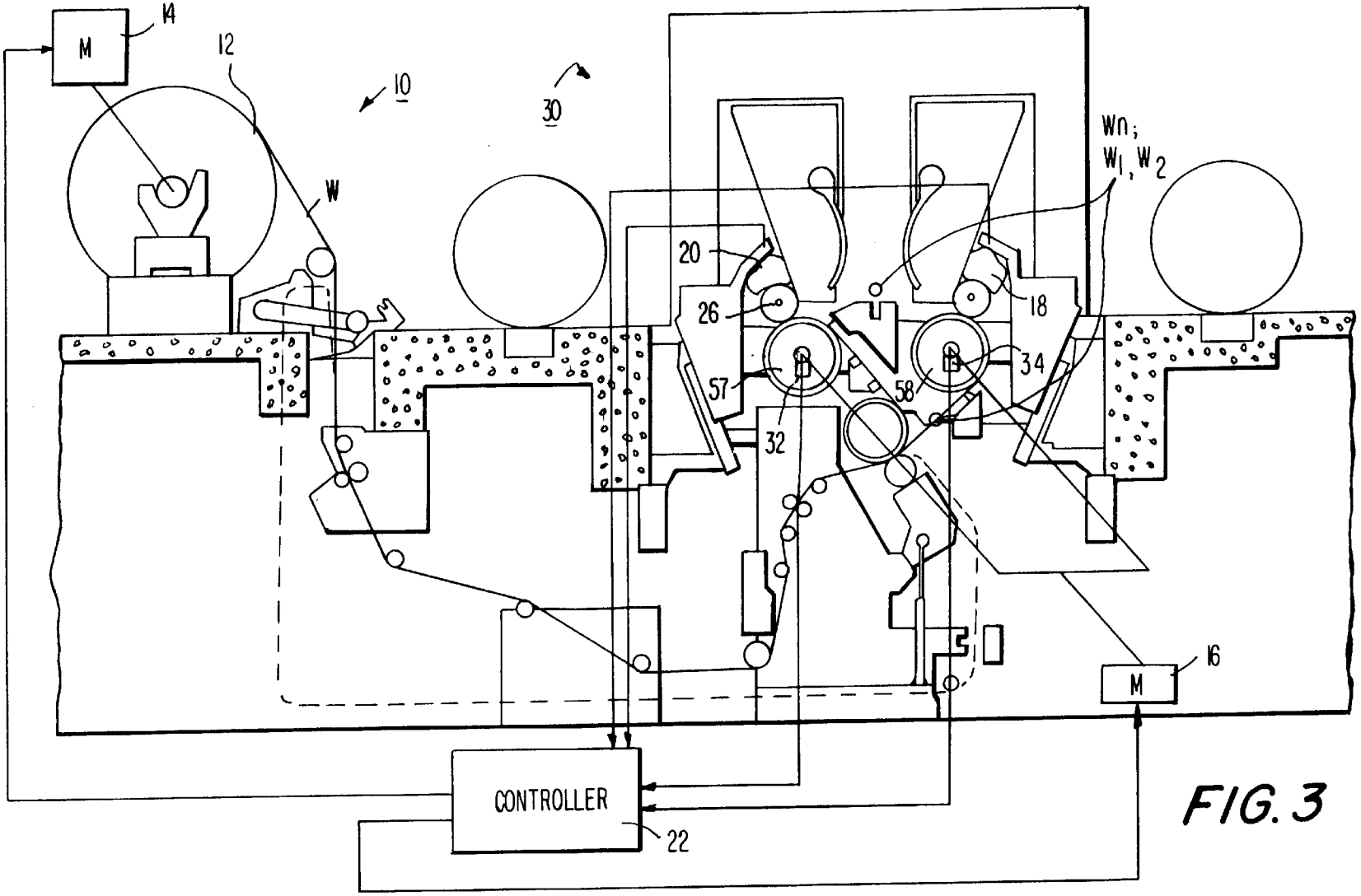
FIG. 3 is a schematic illustration of a conventional winder in which the method in accordance with the invention is applied.

Referring to the accompanying drawings wherein like reference numerals refer to the same or similar elements, the method in accordance with the invention is based on the concept that it is possible to measure the oscillations of a roll onto which a web is being wound by a winder or equivalent winding apparatus with respect to the rotational speed of the roll and based on the measurements of the oscillation of a roll, those ranges of rotation of the roll are known, or determinable/calculatable, in which intensive oscillation occurs.

To illustrate this concept, the horizontal axis in FIG. 1 represents the frequency F of rotation of the roll onto which a web is being wound, and the vertical axis represents the oscillation V of the roll, and the diameter D of the roll increases from right to left during the winding of the web thereon. As shown in FIG. 1, there are two different ranges 1,2 of oscillation of the roll during the winding process, i.e., a range of oscillation being defined as a range at which intensive oscillation occurs.

As shown in FIG. 2, the horizontal axis represents that roll diameter D which increases from left to right, and the first 1 and the second 2 ranges of oscillation are represented by the areas shaded with dashed lines. The frequency F of rotation of the roll during the winding process (e.g., rotations/second) and including a change to minimize oscillations of the roll is represented by the vertical axis. The dashed line illustrates the running speed S of the winder, and the solid curved line T illustrates the frequency F of rotation of the roll as a function of the roll diameter D during a change. It should be appreciated by those skilled in the art that the frequency of rotation of the roll is related to the speed of rotation of the roll and that both these quantities are controllable by conventional winding apparatus in order to ensure adequate winding of a web onto the roll.

In accordance with the invention, control of the running speed S of the winder, for example a slitter-winder, is based on monitoring the frequency F of rotation of the roll. When the frequency F of rotation of the roll is lowered, which occurs in view of the fact that the diameter of the roll increases during winding and thus at a constant running speed the rotational speed must decrease, and approaches close to the upper limit of the first range 1 of oscillation, the running speed S is lowered quickly to such an extent that the speed of rotation of the roll and thus the frequency of rotation of the roll becomes lower than the lower frequency of the first oscillation range 1. After this, the running speed S of the slitter-winder is raised so that the frequency F of rotation of the roll remains substantially constant, which is possible since the diameter of the roll increases during winding and thus it is possible to increase the running speed without changing the frequency of rotation of the roll, until, e.g., the original running speed S is again reached. The original running speed is the running speed prior to the reduction in the running speed to quick transverse the oscillation range. When the frequency F of rotation of the roll is lowered further close to the second oscillation range 2, the procedure described above is repeated. The procedure is similar at all possible ranges of oscillation of the roll.

In certain embodiments, the oscillation of the roll during winding thereof is measured and one or more ranges of oscillation are determined based on the measured oscillation of the roll. The range(s) of oscillation may also be determined based on the grade of paper being wound, i.e., the type of web.

As shown in FIG. 3, in the unwind stand 10 of the winder, a roll 12 to be unwound is placed with its axle in a fork. A motor (generator) 14 is motively coupled to the roll axle in order to rotate the roll 12 at different speeds and thereby cause web W to be unwound from roll 12 at different running speeds. In the winding stand 30 of the winder, components webs $Wn;W_1;W_2$ are wound about support rolls/carrier drums 57,58 into the rolls being formed 26,24, respectively. A motor (generator 16) is motively coupled to the support rolls/carrier drums 57,58 in order to rotate the same at different speeds. In accordance with the invention, the oscillation or vibration of the rolls being formed 24,26 in the winding stand 30 is measured by measuring devices 18,20, respectively, arranged in conjunction with the rider roll support unit. In addition to or instead of measuring devices 18,20, measuring devices 32,34 may be arranged in connection with the support rolls/carrier drums 57,58. Such measuring devices 18,20,32,34, per se, are known to those skilled in the art (see, e.g., Japanese Patent Application Nos. 62-102061 and 04-260872). The controller 22 is coupled to the motors 14,16 in order to regulate motor 14 to unwind roll 12 at a desired unwinding speed and to regulate support rolls/carrier drums 57,58 to rotate at a desired winding speed. Controller 22, e.g., a microcomputer, receives input from the measuring devices 18,20,32,34, and, e.g., during a test or initial run, is able to determine the range of frequencies in which intensive oscillation of the rolls being formed occur (which optionally may be based in part on the grade of the web which is input into the controller). Accordingly, controller 22 controls the speed of the winder, e.g., the unwinding speed via motor 14 and/or the winding speed via motor 16, based on the frequency of rotation of the roll.

In the following, the patent claims will be given, and the various details of the invention can show variation within the scope of the inventive idea defined in the claims and differ even to a considerable extent from the details stated above by way of example only. As such, the examples provided above are not meant to be exclusive and many other variations of the present invention would be obvious to those skilled in the art, and are contemplated to be within the scope of the appended claims.

We claim:

1. In a method for winding a paper web in which the web is wound at a variable running speed by a winder onto a roll and the running speed of the winder is controlled, the improvement comprising the steps of:

controlling the running speed of the winder based on the frequency of rotation of the roll, said controlling step comprising the steps of lowering the running speed of the winder from an initial running speed when the frequency of rotation of the roll approaches a range of frequencies in which intensive oscillation of the roll occurs in order to lower the speed of rotation of the roll and thus lower the frequency of rotation of the roll to a frequency of rotation lower than the lowest frequency of the range of oscillation, and thereafter increasing the running speed of the winder while maintaining the frequency of rotation of the roll substantially constant.

2. The method of claim 1, further comprising the step:

of repeating the running speed lowering step and the subsequent running speed increasing step for all ranges of frequencies of rotation of the roll at which intensive oscillation of the roll occurs.

3. The method of claim 1, further comprising the steps of:

measuring the oscillation of the roll during winding of the roll, and determining the range of oscillation based on the measured oscillation of the roll.

4. The method of claim 1, further comprising the step of determining the range of oscillation based on the grade of the web.

5. The method of claim 1, wherein the running speed of the winder is increased until the initial running speed of the winder is reached.

6. A method for winding a paper web onto a roll, comprising the steps of:

winding the web at a variable running speed by means of a winder onto the roll, and controlling the running speed of the winder based on the frequency of rotation of the roll, said controlling step comprising the steps of lowering the running speed of the winder from an initial running speed when the frequency of rotation of the roll approaches a range of frequencies in which intensive oscillation of the roll occurs in order to lower the speed of rotation of the roll and thus lower the frequency of rotation of the roll to a frequency of rotation lower than the lowest frequency of the range of oscillation, and thereafter increasing the running speed of the winder while maintaining the frequency of rotation of the roll substantially constant.

7. The method of claim 6, further comprising the step of:

repeating the running speed lowering step and the subsequent running speed increasing step for all ranges of frequencies of rotation of the roll at which intensive oscillation of the roll occurs.

8. The method of claim 6, further comprising the steps of:

measuring the oscillation of the roll during winding of the roll, and determining the range of oscillation based on the measured oscillation of the roll.

9. The method of claim 6, further comprising the step of:

determining the range of oscillation based on the grade of the web.

10. The method of claim 6, wherein the running speed of the winder is increased until the initial running speed of the winder is reached.

* * * * *